US006281622B1

(12) United States Patent
Valentian et al.

(10) Patent No.: US 6,281,622 B1
(45) Date of Patent: Aug. 28, 2001

(54) CLOSED ELECTRON DRIFT PLASMA THRUSTER ADAPTED TO HIGH THERMAL LOADS

(75) Inventors: Dominique Valentian, Rosny-sur-Seine; Jean-Pierre Bugeat, Combs la Ville; Eric Klinger, Fontainebleau, all of (FR)

(73) Assignee: Societe Nationale d'Etude et de Construction de Moteurs d'Aviation - S.N.E.C.M.A, Paris (FR)

( * ) Notice: Subject to any disclaimer, the term of this patent is extended or adjusted under 35 U.S.C. 154(b) by 0 days.

(21) Appl. No.: 09/378,795

(22) Filed: Aug. 23, 1999

(30) Foreign Application Priority Data

Aug. 25, 1998 (FR) ..... 98 10674

(51) Int. Cl.[7] ..... H01J 27/02; H05H 1/54

(52) U.S. Cl. ..... 313/362.1; 313/161; 313/231.01; 313/231.51; 315/500; 315/501; 315/505; 315/507; 60/202

(58) Field of Search ..... 313/362.1, 161, 313/231.01–231.51; 315/111.41, 111.21, 111.61, 500, 505, 501, 507; 60/202

(56) References Cited

U.S. PATENT DOCUMENTS 5,763,989 6/1998 Kaufman ..... 313/361.1
6,158,209 * 12/2000 Latischev et al. ..... 60/202
6,208,080 * 3/2001 King et al. ..... 315/111.41

FOREIGN PATENT DOCUMENTS

0541309 A1 5/1993 (EP) .
0781921 A1 7/1997 (EP) .
2693770 1/1994 (FR) .

* cited by examiner

*Primary Examiner*—Nimeshkumar D. Patel
*Assistant Examiner*—Ken A Berck
(74) *Attorney, Agent, or Firm*—Weingarten, Schurgin, Gagnebin & Hayes LLP

(57) ABSTRACT

The closed electron drift plasma thruster uses a magnetic circuit to create a magnetic field in a main annular channel for ionization and acceleration, said magnetic circuit comprises: an essentially radial first outer pole piece; a conical second outer pole piece; an essentially radial first inner pole piece; a conical second inner pole piece; a plurality of outer magnetic cores surrounded by outer coils to interconnect the first and second outer pole pieces; an axial magnetic core surrounded by a first inner coil and connected to the first inner pole piece; and a second inner coil placed upstream from the outer coils. The thruster also comprises a plurality of radial arms included in the magnetic circuit, and a structural base which is separate from the magnetic circuit and which serves, amongst other things, to cool the coils.

28 Claims, 8 Drawing Sheets

CLOSED ELECTRON DRIFT PLASMA THRUSTER ADAPTED TO HIGH THERMAL LOADS

FIELD OF THE INVENTION

The present invention relates to a closed electron drift plasma thruster adapted to high thermal loads, the thruster comprising a main annular channel for ionization and acceleration that is defined by parts made of insulating material and that is open at its downstream end, at least one hollow cathode disposed outside the main annular channel adjacent to the downstream portion thereof, an annular anode concentric with the main annular channel and disposed at a distance from the open downstream end, a pipe and a distribution manifold for feeding the annular anode with an ionizable gas, and a magnetic circuit for creating a magnetic field in the main annular channel.

PRIOR ART

Closed electron drift plasma thrusters having the structure shown in section in FIG. 13 are already known, e.g. from document EP-A-0 541 309.

A thruster of that type comprises a cathode 2, an anode-forming gas distribution manifold 1, an annular acceleration channel (discharge chamber) 3 defined by inner and outer walls 3*a* and 3*b*, and a magnetic circuit comprising an outer pole 6, an inner pole 7, a central core 12, a magnetic jacket 8, an inner coil 9, and an outer coil 10.

The annular acceleration channel 3 is situated between an inner magnetic screen 4 and an outer magnetic screen 5 enabling the gradient of the radial magnetic field in the channel 3 to be increased. The channel 3 is connected to the outer pole piece 6 by a cylindrical metal part 17.

From the thermal point of view, the channel 3 is surrounded not only by the magnetic screens 4 and 5, but also by thermal screens 13 opposing radiation towards the axis and the central coil, and also to the outside. The only effective possibility for cooling by radiation is situated at the downstream end of the channel 3 which is open to space. As a result, the channel temperature is higher than it would be if the channel 3 could radiate through its outer lateral face.

Document WO 94/02738 discloses a closed electron drift plasma thruster 20 in which an acceleration channel 24 is connected upstream to a buffer or calming chamber 23, as shown in FIG. 14 which is an elevation view in half-axial section of such a structure.

The plasma thruster shown in FIG. 14 comprises an annular main channel 24 for ionization and acceleration defined by parts 22 of insulating material and open at its downstream end 25*a*, at least one hollow cathode 40, and an annular anode 25 concentric with the main channel 24. Ionizable gas feed means 26 open out upstream of the anode 25 through an annular distribution manifold 27. Means 31 to 33 and 34 to 38 for creating a magnetic field in the main channel 24 are adapted to produce a magnetic field in the main channel 24 that is essentially radial, having a gradient with maximum induction at the downstream end 25*a* of the channel 24. These magnetic field creation means essentially comprise an outer coil 31 surrounded by magnetic shielding, outer and inner pole pieces 34 and 35, a first axial core 33, a second axial core 32 surrounded by magnetic shielding, and a magnetic yoke 36.

The calming chamber 23 can radiate freely to space and thus contributes to cooling the channel 24. However, the toroidal outer coil 31 opposes cooling of the channel 24 in its portion carrying the greatest heat load. In addition, the first inner coil 33 must provide a very high number of ampere-turns for the volume made available to it by the magnetic screen associated with the second axial coil 32. This gives rise to a very high temperature.

Presently known closed electron drift plasma thrusters, which can also be referred to as stationary plasma thrusters, are used essentially for north-south control of geostationary satellites.

The structural characteristics of presently known closed electron drift plasma thrusters do not make it possible to optimize evacuation of the heat flux in operation. As a result, closed electron drift plasma thrusters cannot have a power level that is high enough to provide the primary propulsion of a mission such as transferring to geostationary orbit or an interplanetary mission, particularly since the ratio of area over dissipated power is smaller for a thruster that is large, which means that the temperature of a large plasma thruster of known type increases excessively, or that the mass of such a large known plasma thruster becomes excessive if heat flux is kept constant.

OBJECT AND BRIEF SUMMARY OF THE INVENTION

The invention seeks to remedy the above-specified drawbacks and to make it possible to optimize operation and heat flux evacuation in closed electron drift plasma thrusters in such a manner as to provide plasma thrusters of greater power than that of presently known closed electron drift plasma thrusters.

The invention thus seeks to propose a novel configuration for a closed electron drift thruster in which the thermal and structural design is improved compared with presently known plasma thrusters.

These objects are achieved by a closed electron drift plasma thruster adapted to high thermal loads, the thruster comprising a main annular channel for ionization and acceleration that is defined by parts made of insulating material and that is open at its downstream end, at least one hollow cathode disposed outside the main annular channel adjacent to the downstream portion thereof, an annular anode concentric with the main annular channel and disposed at a distance from the open downstream end, a pipe and a distribution manifold for feeding the annular anode with an ionizable gas, and a magnetic circuit for creating a magnetic field in the main annular channel, wherein the magnetic circuit comprises:

- an essentially radial first outer pole piece;
- a conical second outer pole piece;
- an essentially radial first inner pole piece;
- a conical second inner pole piece;
- a plurality of outer magnetic cores surrounded by outer coils to interconnect the first and second outer pole pieces;
- an axial magnetic core surrounded by a first inner coil and connected to the first inner pole piece; and
- a second inner coil placed upstream from the outer coils.

The presence of a plurality of outer magnetic cores interconnecting the first and second outer pole pieces allows a large portion of the radiation coming from the inner wall of the ceramic channel to pass between them. The conical shape of the second outer pole piece makes it possible to increase the volume available for the outer coils and to increase the solid angle over which radiation can take place. The conical shape of the second inner pole piece also makes it possible to increase the volume available to the first inner coil while still channelling the magnetic flux so as to perform a shielding function for the second inner coil.

Advantageously, the plasma thruster has a plurality of radial arms connecting the axial magnetic core to the upstream portion of the conical second inner pole piece, and a plurality of second radial arms extending the first radial arms and connected to said plurality of outer magnetic cores and to the upstream portion of the conical second outer pole piece.

The number of first radial arms and the number of second radial arms is equal to the number of outer magnetic cores.

A small gap is left between each first radial arm and the corresponding second radial arm, so as to add to the effect of the second inner coil.

In a remarkable aspect of the present invention, the plasma thruster includes a structural base of a material that is a good conductor of heat which constitutes a mechanical support of the thruster, which is distinct from the axial magnetic core, from the first and second outer pole pieces, and from the first and second inner pole pieces, and which serves to cool the first inner coil, the second inner coil, and the outer coils by conduction.

Advantageously, the structural base is covered on its lateral faces in an emissive coating.

Advantageously, the main annular channel has a section in an axial plane that is frustoconical in shape in its upstream portion and cylindrical in shape in its downstream portion, and the annular anode has a section in an axial plane that tapers in the form of a truncated cone.

According to a particular characteristic, the parts defining the main annular channel define an annular channel in the form of a single block, are connected to the base by a single support provided with expansion slots, and are secured to the single support by screw engagement.

In another particular embodiment, the annular main channel has a downstream end defined by two ring-shaped parts made of an insulating ceramic and each connected to the base via an individual support, and the upstream portion of the annular main channel is embodied by the walls of the anode which is electrically isolated from the supports by vacuum. The individual supports are coaxial.

By way of example, the ratio between the axial length of the parts made of insulating ceramic and the width of the channel lies in the range 0.25 to 0.5, and the distance between the walls of the anode and the support of the parts made of insulating ceramic lies in the range 0.8 mm to 5 mm.

The anode is fixed relative to the base by means of a solid column and by flexible blades.

Recesses can be milled in the base to receive the second radial arms, the ionizable gas feed pipe fitted with an isolator, a line for biasing the anode, and wires for powering the outer coils and the first and second inner coils.

Because of the presence of a structural base, the magnetic circuit can perform essentially the function of channelling the magnetic flux, while the solid base made of a material that is a good conductor of heat, e.g. a light alloy anodized on its lateral face, or of composite carbon-carbon material coated on its downstream face with a deposit of copper, serves simultaneously to cool the coils by conduction and to evacuate the heat losses by radiation, and also to provide the structural strength of the thruster.

The plasma thruster includes sheets of super-insulation material disposed upstream of the main annular channel, and sheets of super-insulation material interposed between the main annular channel and the first inner coil.

In a first possible configuration, the cone of the conical upstream second inner pole piece points downstream.

In another possible configuration, the cone of the conical upstream second inner pole piece points upstream.

According to another particular characteristic of the invention, the plasma thruster includes a common support for supporting the first inner coil, the conical second inner pole piece, and the second inner coil which are fixed to said common support by brazing or by diffusion welding, and said common support is assembled on the base by screw means with a thermally conductive sheet being interposed therebetween.

In a particular embodiment, in order to improve the cooling of the first inner coil which carries the greatest thermal loading, the first inner coil is cooled by a heat pipe connected to the inner portion of the common support and situated in a recess of the magnetic core.

In a variant, the first inner coil is cooled by a plurality of heat pipes connected to the upstream portion of the common support and passing through orifices formed in the second inner pole piece.

Preferably, the conical second outer pole piece has openings therein.

The first and second outer pole pieces are mechanically connected together by a non-magnetic structural link piece that has openings.

In a variant embodiment, the outer magnetic cores of the outer coils are inclined at an angle $\beta$ relative to the axis of the thruster in such a manner that the axes of the outer magnetic cores are substantially perpendicular to the bisector of the angle formed by the generator lines of the cones of the first and second outer pole pieces.

According to another particular characteristic, the annular anode includes a manifold provided with internal baffles and having a plane downstream plate co-operating with the walls of the main channel to define two annular diaphragms, a rear plate fitted to the walls of the main channel to limit gas leakage in the upstream direction, and cylindrical walls provided with holes for injecting ionizable gas into the main channel.

BRIEF DESCRIPTION OF THE DRAWINGS

Other characteristics and advantages of the invention appear from the following description of particular embodiments given as examples and with reference to the accompanying drawings, in which.

DETAILED DESCRIPTION OF PARTICULAR EMBODIMENTS OF THE INVENTION

Figure 1:
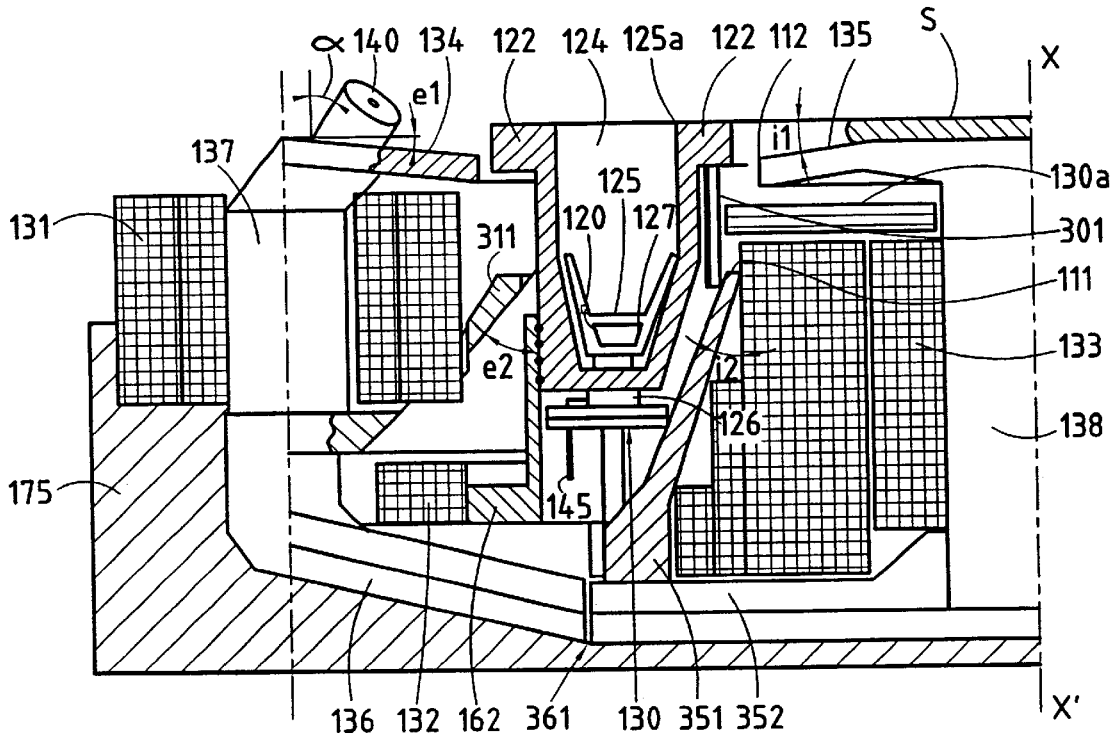
FIG. 1 is an axial half-section view of a first particular embodiment of a closed electron drift plasma thruster of the invention.
Figure 2:
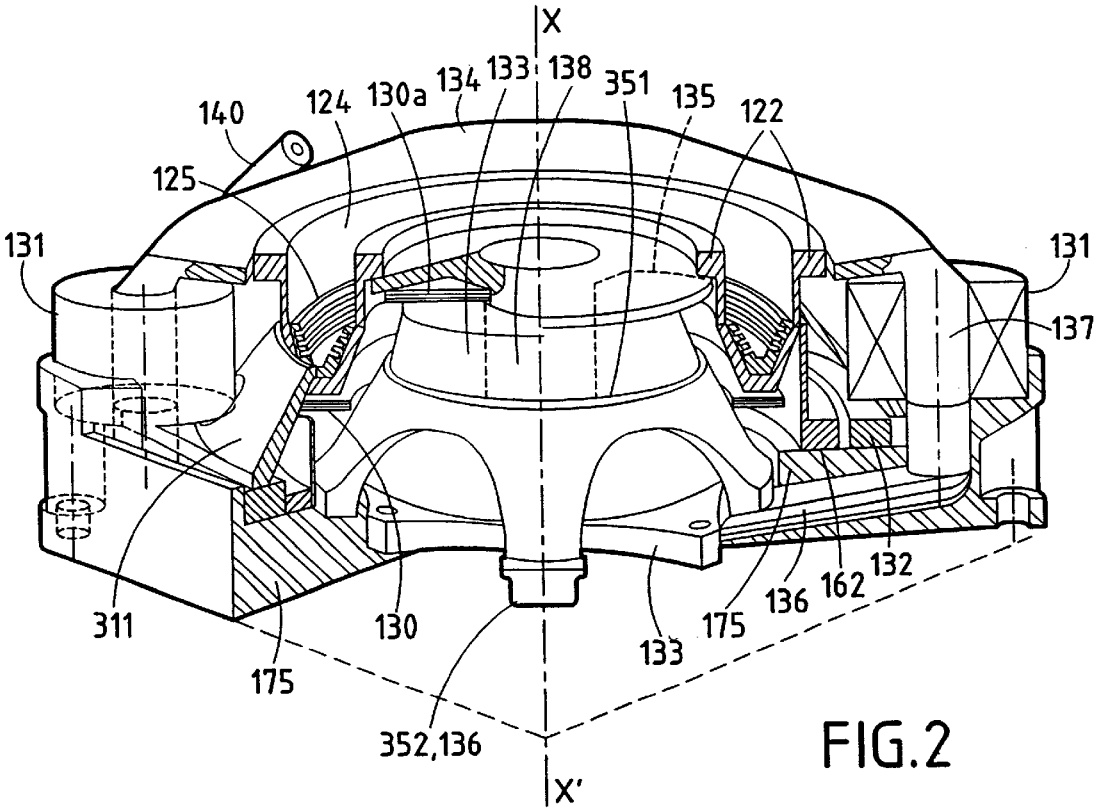
FIG. 2 is a partially cutaway perspective view of the FIG. 1 plasma thruster.

Reference is made initially to FIGS. 1 and 2 showing a first example of a closed electron drift plasma thruster of the present invention.

The closed electron drift plasma thruster of FIGS. 1 and 2 comprises a main annular channel 124 for ionization and acceleration which is defined by insulating walls 122. The channel 124 is open at its downstream end 125*a* and in an axial plane its section is frustoconical in shape in its upstream portion and cylindrical in its downstream portion.

A hollow cathode 140 is disposed outside the main channel 124 and is advantageously at an angle $\alpha$ relative to the axis X'X of the thruster, where a lies in the range 15° to 45°.

In an axial plane, an annular anode 125 has a tapering section in the form of a truncated cone that is open in a downstream direction.

The anode 125 can have slots increasing its surface area in contact with the plasma. Holes 120 for injecting an ionizable gas coming from an ionizable gas distribution manifold 127 are formed through the wall of the anode 125. The manifold 127 is fed with ionizable gas by a pipe 126.

Particular examples of the anode 125 are described below with reference to FIGS. 4 and 5.

The discharge between the anode 125 and the cathode 140 is controlled by a magnetic field distribution that is determined by a magnetic circuit.

The magnetic circuit comprises a first outer pole piece 134 that is essentially radial. This outer pole piece 134 can be plane or slightly conical defining an angle $e_1$ lying in the range +15° to −15° relative to the outlet plane S (FIG. 1).

The outer pole piece 134 is connected by a plurality of magnetic cores 137 surrounded by outer coils 138 to a second outer pole piece 311 of conical shape that is more marked than the possibly slightly conical shape of the first outer pole piece 134. The half-angle $e_2$ of the cone of the outer pole piece 311 can lie in the range 25° to 60°. The outer pole piece 311 is advantageously open in register with the passages for the outer coils 131 so as to reduce radial size, and between the coils so as to improve cooling by radiation from the ceramic constituting the walls 122 of the channel 124.

An essentially radial first inner pole piece 135 can be plane or can be slightly conical, defining an angle $i_1$ lying in the range −15° to +15° relative to the outlet plane S.

The first inner pole piece 135 is extended by a central axial magnetic core 138 surrounded by a first inner coil 133. The axial magnetic core 138 is itself extended at the upstream portion of the thruster by a plurality of radial arms 352 connected to a second inner pole piece 135 that is upstream and conical, presenting a half-angle $i_2$ lying in the range 15° to 45° relative to the axis X'X of the thruster. In the embodiment of FIGS. 1 and 2, the cone of the second inner pole piece 351 points downstream. Throughout the present description, the term "downstream" means towards a zone close to the outlet plane S and the open end 125*a* of the channel 124, while the term "upstream" means towards a zone remote from the outlet plane S going towards the closed portion of the annular channel 124 that is fitted with the anode 125 and the ionizable gas feed manifold 127.

A second inner magnetic coil 132 is placed outside the upstream portion of the second inner pole piece 351. The magnetic field of the second inner coil 132 is channelled by radial arms 136 placed in line with the radial arms 352, and by the outer pole piece 311 and the inner pole piece 351. A small gap, e.g. about 1 mm to 4 mm across can be left between the radial arms 352 and the radial arms 136 so as to complete the effect of the second inner coil 132.

The axial magnetic core 138 is connected to the outer magnetic cores 137 by a plurality of magnetic arms 136 placed in line with the radial arms 352. The number of radial arms 352 and the number of radial arms 136 is equal to the number of outer coils 131 placed on the outer magnetic cores 137.

According to an important aspect of the present invention, the coils 133, 131, and 132 are cooled directly by conduction via a structural base 175 of heat-conductive material, said base 175 also serving as a mechanical support for the thruster. The base 175 is advantageously provided on its lateral faces with an emissive coating for improving the radiation of heat losses into space.

The base 175 can be made of light alloy, being anodized on its lateral face so as to increase its emissivity.

The base 175 can also be made of a carbon-carbon composite material coated on its downstream face with a deposit of a metal such as copper so as to maximize the emissivity of the lateral faces and minimize the absorptivity of the downstream face subject to radiation from the ceramic of the channel.

The presence of a massive base 175 acting both as a structural support and as means for cooling the coils 131, 133, and 132 by conduction makes it possible for the magnetic circuit proper to be lightened as much as possible.

In the example of FIGS. 1 and 2, the magnetic circuit has four outer coils 131, two of which can be seen in FIG. 2. Nevertheless, it would be possible to implement a number of outer coils 131 other than four.

The outer coils 131 and the associated magnetic cores 137 serve to create a magnetic field that is channelled in part by the downstream and upstream outer pole pieces 134 and 311. The remainder of the magnetic field is taken up by the arms 136 grouped around the axial magnetic core 138 which is itself provided with the downstream inner pole piece 135, the first axial coil 133, the upstream conical second pole piece 351, and the second coil 132.

The magnetic flux supplied by the coil 132 is channelled by the pole piece 351, the core 138, the radial arms 136, and the pole piece 311, so that the coil 132 has no need for special magnetic shielding.

Figure 7:
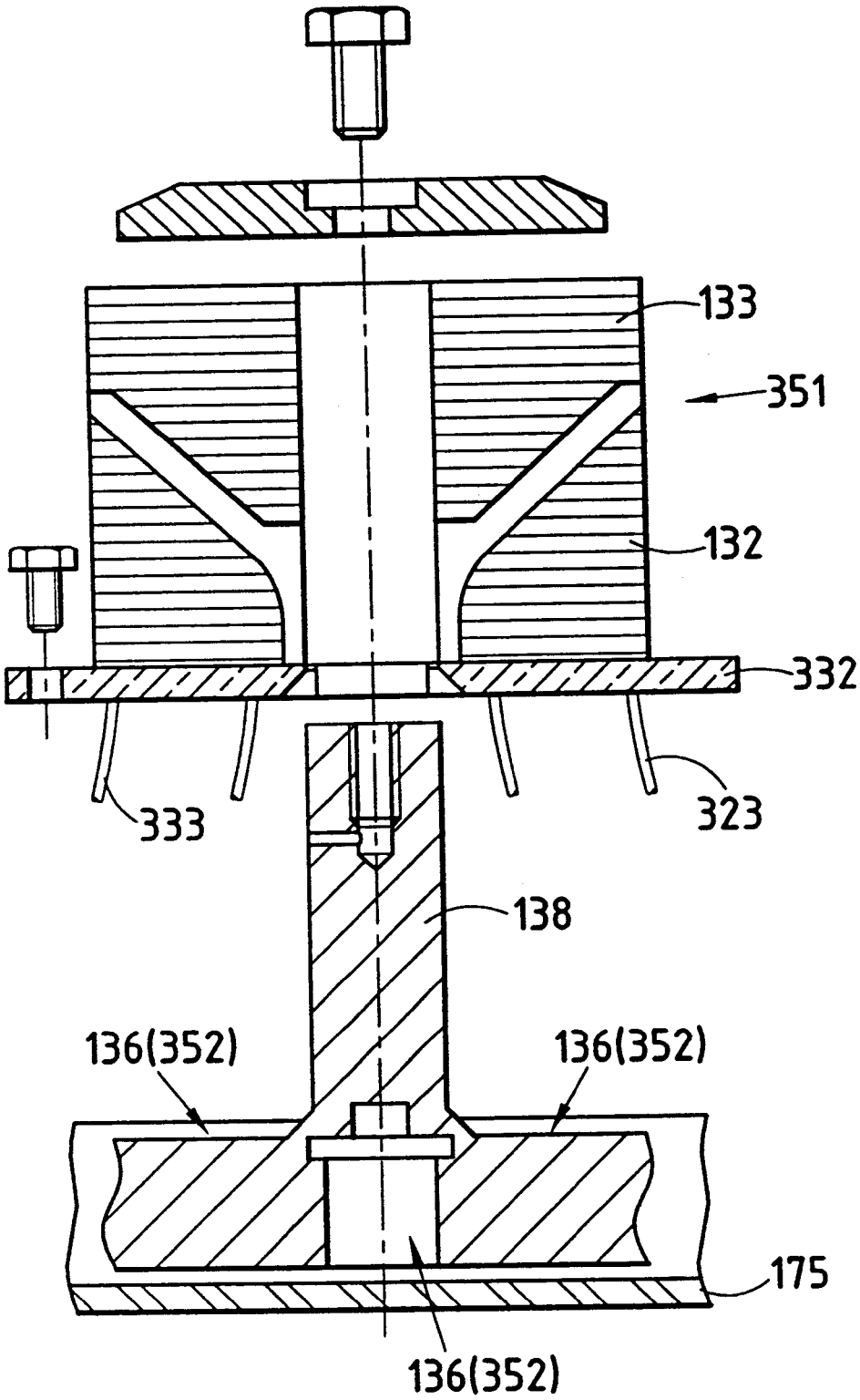
FIG. 7 is an exploded view of the central portion of a plasma thruster of the invention.

With reference to FIG. 7, it can be seen that the coil 133, the pole piece 351, and the coil 132 co-operate with a common support 332 to form an assembly which counts as a single block both mechanically and thermally speaking, this single block assembly being energetically cooled by conduction via the base 175.

The coil 133, the pole piece 351, and the coil 132 can be secured to the common support 332 by brazing or by diffusion welding. The support 332 can itself be assembled to the base 175 by means of a screw. A conductive sheet is interposed between the base 175 and the support 332 so as to reduce the thermal resistance of the contact between them. The bore inside the pole piece is fitted to the axial magnetic core 138 so as to enable the two inner coils 133 and 132 and the pole piece 351 to be mounted together on the core 138.

In traditional plasma thrusters, the structure 122 of ceramic material defining the annular channel 124 is held relative to the outer pole piece by a metal support.

Figure 6:
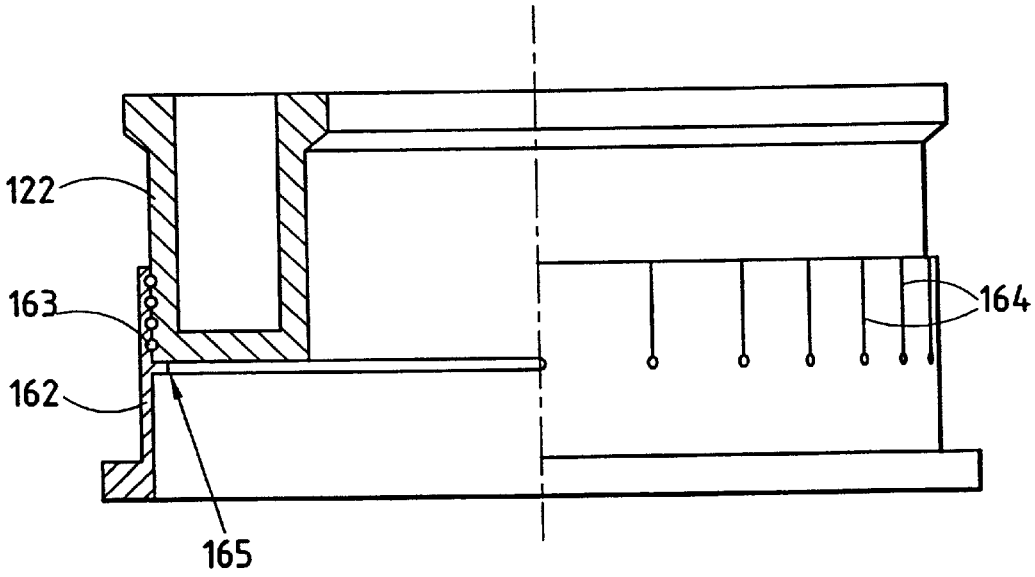
FIG. 6 is an elevation view in half-section of an annular channel support for a particular embodiment of a plasma thruster of the invention.

In the present invention, as shown for example in FIGS. 1, 2, and 6, the structure 122 of ceramic material defining the channel 124 is fixed to the rear (i.e. upstream end) of the thruster by a metal support 162 so that the support does not constitute an obstacle to radiation from the downstream portion of the part 122 which is thus free to radiate into space.

Certain ceramics based on boron nitride are difficult to braze to metals. This problem can be eliminated if a mechanical fastening is used.

By way of example, it is possible to provide a thread of semicircular profile both in the part 122 made of ceramic material and in the support 162. It is then possible to slide a wire 163 between the two parts 122 and 162 so as to hold them together. Such a disposition makes it possible to install the ceramic part 122 on the support 162 that has previously been mounted on the elements of the magnetic circuit.

The metal support 162 can be provided with a rib 165 and with notches 164 defining fingers making it possible to compensate differential expansion between the metal and the ceramic while also providing resilient clamping.

In a variant, it is also possible to use a mount in which the ceramic 122 is screwed into the support 162, with the fixing stub of the support then being inverted, i.e. facing towards the inside of the cylindrical support 162, and having openings to pass the wire 142 for biasing the anode and the pipe 126 for feeding the manifold 127 with ionizable gas.

Figure 11:
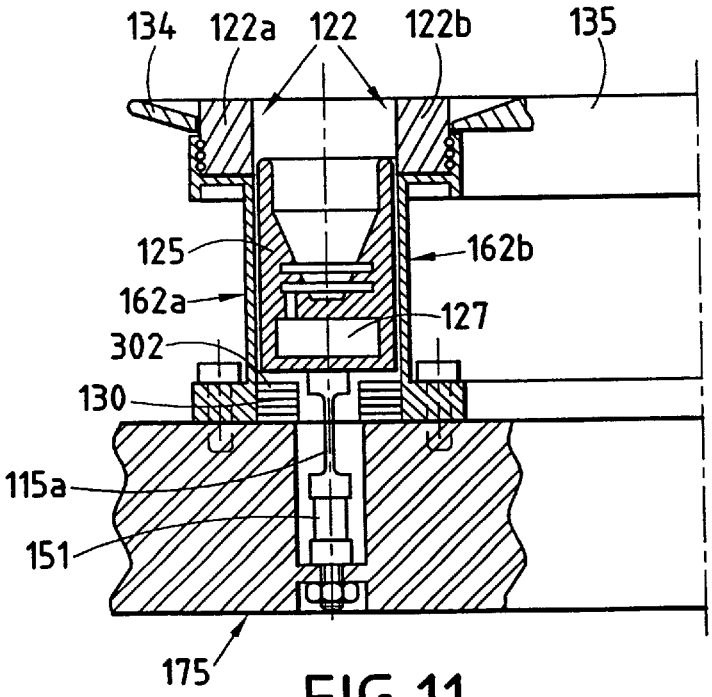
FIG. 11 is a fragmentary view in axial half-section showing an anode forming a portion of the body of an acceleration channel in a particular embodiment of a plasma thruster of the invention.

FIG. 11 shows another variant embodiment of the channel 124.

For a thruster that delivers high thrust, i.e. that is of large diameter, it is difficult to make a one-piece ceramic part to define the annular channel 124. Under such circumstances, the part 122 that is made of ceramic material is subdivided into two distinct rings 122*a* and 122*b* that are mounted on distinct supports 162*a* and 162*b*.

The ratio between the length of the ring-shaped ceramic supports 122*a* and 122*b* to the width of the channel 124 can typically lie in the range 0.25 to 0.5. The remainder of the channel 124 is embodied by the walls of the anode 125. Electrical insulation between the anode 125 and the two supports 162*a* and 162*b* is provided by the vacuum. The distance between the walls of the anode 125 and the supports 162*a* and 162*b* constitutes a small amount of clearance lying in the range 0.8 mm to 5 mm.

The anode 125 shown in FIG. 11 is supported by isolators such as 151 fixed on the solid base 175 which constitutes a natural electrostatic screen for the isolators such as 151. The isolators 151 are extended by flexible blades 115*a* which protect them from differential expansion forces.

For a plasma thruster of large diameter, it can also be advantageous to implement an upstream inner pole piece 351 whose cone points upstream rather than downstream. The large diameter of the coil 133 in its downstream portion makes it possible to compensate the fact that the coil is of upstream section that is smaller than a large-based trapezium shape, which can make it easier to integrate ring supports 162*a* and 162*b* associated with separate rings 122*a* and 122*b*.

Nevertheless, it should be observed that for plasma thrusters of diameter that is not too great, making the upstream inner pole piece 351 in the form of a cone pointing downstream makes it possible to increase the area of contact between the coil 133 of trapezium-shaped section and the base 175 (FIG. 1) while retaining a large volume for the downstream inner coil 133 without that making it necessary to act on the positions of the ends 111 and 112 of the pole pieces 351 and 135 which determine how the magnetic field is distributed.

The use of outer coils 131 (of which there may be three to eight, for example) fitted with magnetic cores 137 disposed between the outer pole pieces 134 and 311 allows a large portion of the radiation coming from the outer wall of the annular channel 124 to escape. The conical shape of the second outer pole piece 311 makes it possible to increase the volume available for the outer coils 131 and to increase the solid angle over which radiation takes place. The conical outer pole piece 311 is also advantageously provided with openings to increase the visible fraction of the ceramic parts 122 so as to obtain a magnetic circuit that is very compact and with a large amount of open space, thereby allowing radiation to take place from the entire lateral face of the channel 124.

Figure 9:
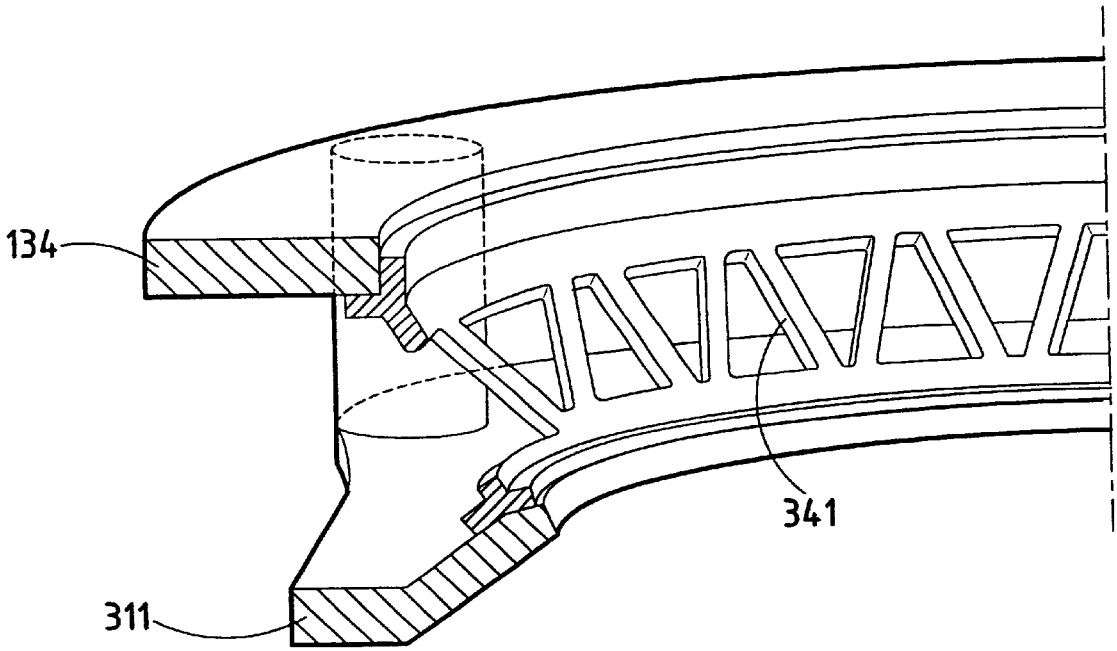
FIG. 9 is a perspective view showing structural reinforcement between the outer pole pieces of a magnetic circuit of a plasma thruster of the invention.

As already mentioned, the base 175 performs an essentially structural function. This solid base 175 has a resonant frequency that is high. The same must be true of the pole pieces. Unfortunately, if openings are made in the upstream outer pole piece 311, then its resonant frequency becomes relatively low. Similarly, the essentially plane shape of the downstream outer pole piece 134 also gives rise to a resonant frequency that is not very high. To remedy this problem, it is possible to interpose a non-magnetic link piece 341 (FIG. 9) of essentially conical shape between the two pole pieces 311 and 134. To allow radiation to take place, the piece 341 must itself be very open, however that does not harm its resonant frequency since the trellis-shaped elements of which it is constituted work essentially in traction and in compression.

Figure 10:
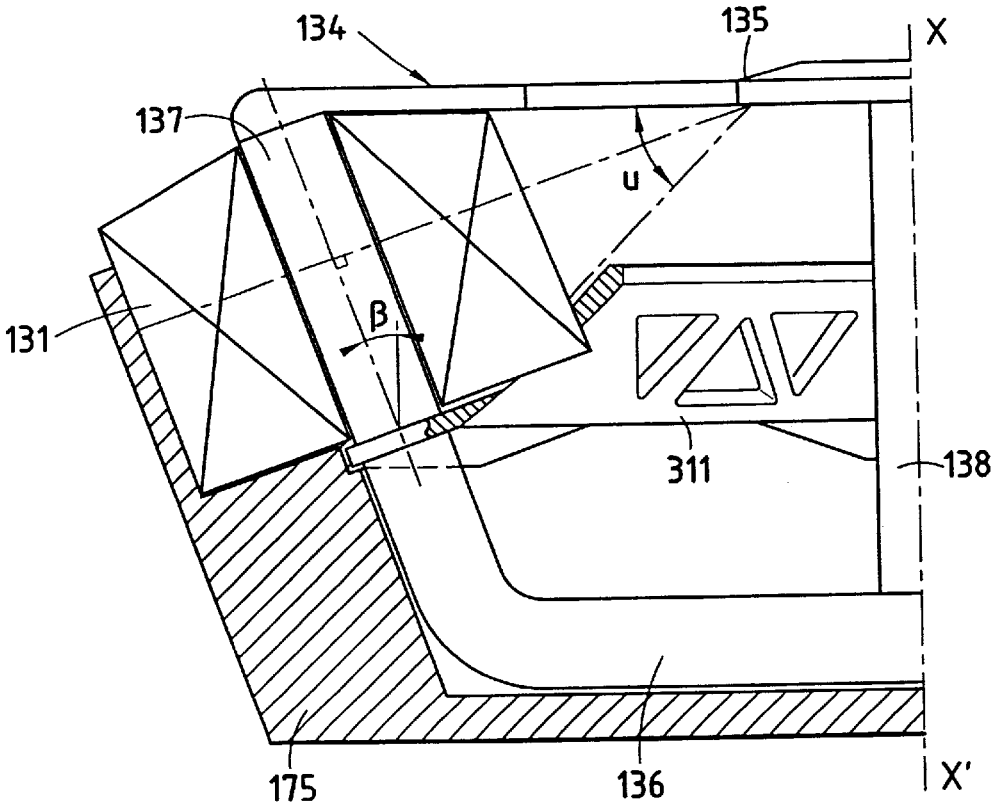
FIG. 10 is a fragmentary diagrammatic view showing a particular embodiment of a plasma thruster fitted with inclined outer coils, in a variant embodiment of the invention.

In a variant embodiment, shown in FIG. 10, the ratio between the shape of the pole pieces 134 and 311 and the volume available for the outer coils is improved by inclining the axes of the coils. Thus, if the outer coils 131 form an angle β with the axis X'X of the thruster, such that the axis of an outer coil 131 is substantially perpendicular to the bisector of the angle u formed by the generator lines of the cones of the two pole pieces 134 and 311, then an outer coil 131 can be of larger volume and the size of the base 175 can be reduced. As shown in FIG. 10, where the channel 124, the coils 133 and 132, and the pole piece 351 have been omitted for reasons of clarity, it is quite possible to combine the use of inclined outer coils 131 with an outer conical pole piece 311 having openings.

As already mentioned above, the base 175 plays an essential role in cooling by conduction of the common support 322, the coils 133 and 132, and the pole piece 351 which is itself advantageously provided with notches as shown in FIG. 2.

Figure 8:
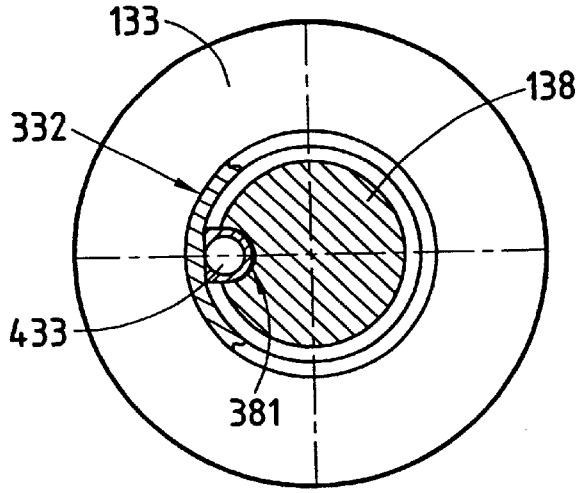
FIG. 8 is a section showing a heat pipe associated with a first inner coil of a plasma thruster of the invention.

However, cooling of the coil 133 which carries the greatest thermal load can be improved by using one or more heat pipes. Thus, in FIG. 8, there can be seen a heat pipe 433 organized in a recess 381 of the axial magnetic core 138, but not coming into contact therewith. The heat pipe 433 can be welded or brazed to the inner face of the inner support 332 of the coil 133, so as to make the support 332 isothermal.

Figure 3:
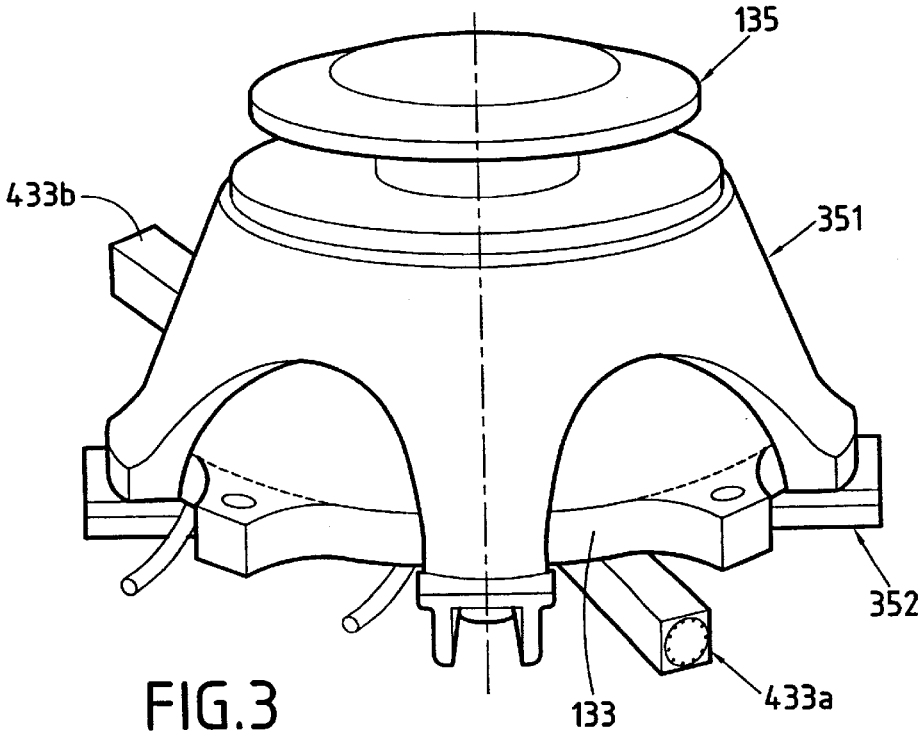
FIG. 3 is a perspective view of the central portion of a plasma thruster of the invention fitted with heat pipes.

FIG. 3 shows a coil 133 cooled by a plurality of heat pipes 433*a*, 433*b* connected to the upstream portion of the support for the coil 133, and passing through orifices formed in the upstream inner pole piece 351.

With reference again to FIGS. 1 and 2 there can be seen sheets of super-insulating material forming a screen 130 placed upstream of the annular channel 124, and sheets of super-insulating material 301 forming a screen which are interposed between the channel 124 and the first inner coil 133. The super-insulating screens 130 and 301 thus eliminate the main part of the flux radiated by the channel 124 towards the inner coils 133, 132 and the base 175. In contrast, the parts 122 defining the channel 124 are free to radiate into space through the solid angle between the pole pieces 134 and 311.

In the embodiment of FIG. 11, an electrostatic screen 302 is disposed upstream from the anode 125 to ensure that Paschen's law is complied with (insulation by vacuum) while contributing to holding the sheets of super-insulating material 130 in place. In addition, the outer face of the outer support 162*a* can receive an emissive coating to improve cooling of the ceramic of the parts 122*a* and 122*b*.

Figure 12:
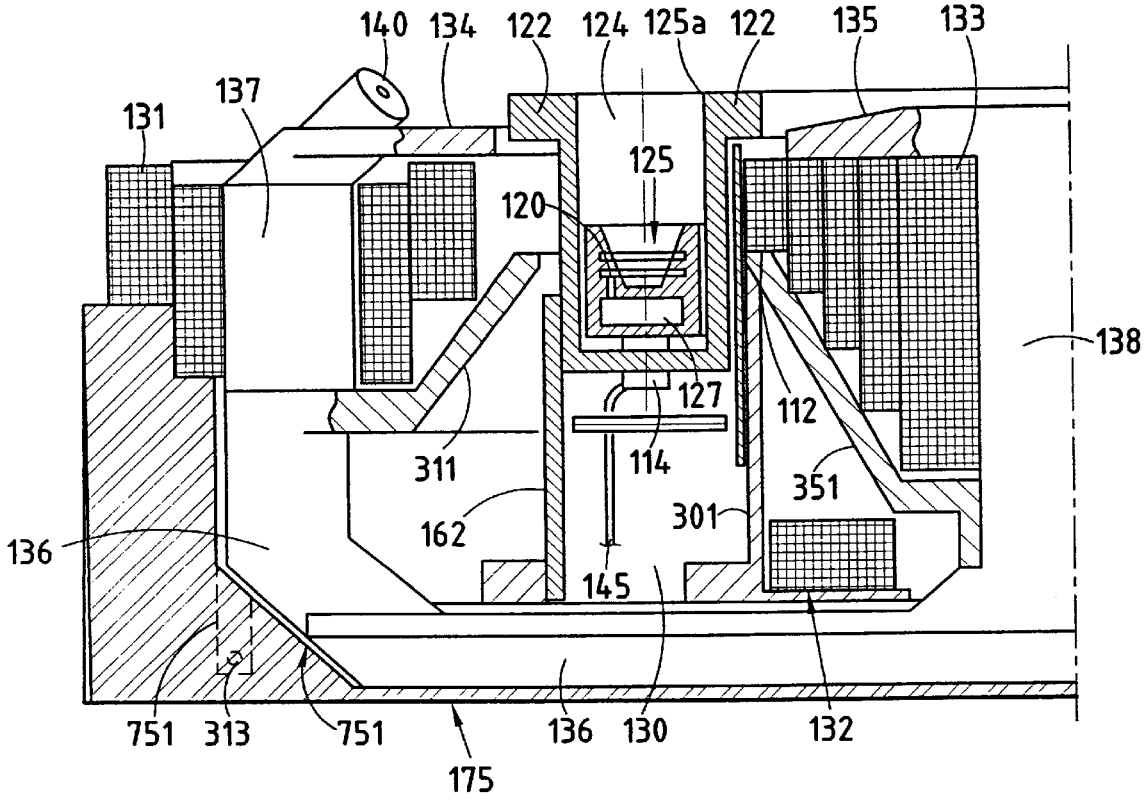
FIG. 12 is an axial half-section view of another particular embodiment of a closed electron drift plasma thruster of the invention.
Figure 13:
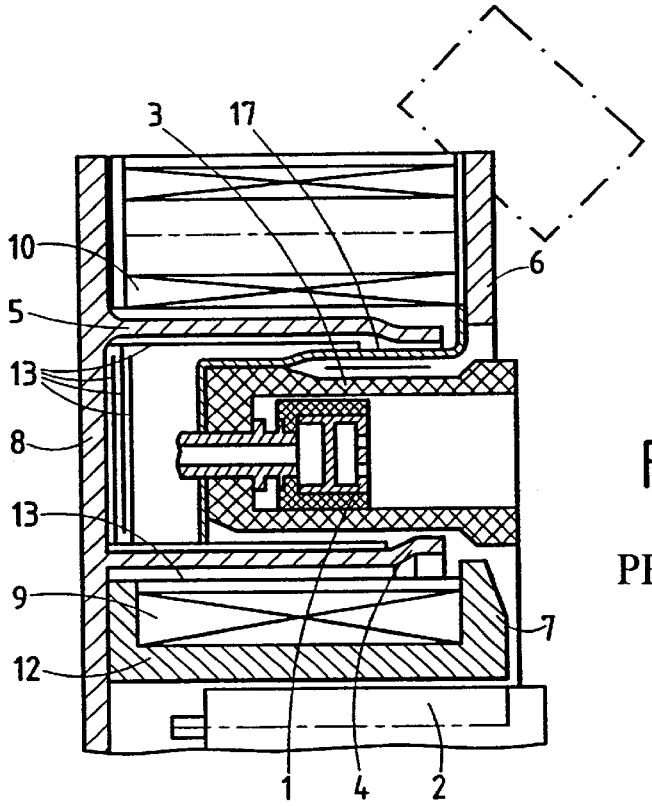
FIG.13 PRIOR ART
FIG. 13 is an axial half-section view of a first prior art closed electron drift plasma thruster.

FIG. 12 shows a particular embodiment of a plasma thruster of the invention in which the cone of the upstream second inner pole piece 351 points upstream. This disposition is more particularly adapted to thrusters of large diameter, but it can be used equally well with an acceleration channel 124 defined by a one-piece part 122 of ceramic material as shown in FIG. 12, or with an acceleration channel 124 defined by two distinct parts 122*a* and 122*b* of ceramic material, as described above with reference to FIG. 11. In FIG. 12, the various elements functionally equivalent to elements described above with reference to the above-described figures, and in particular FIGS. 1 and 2, are given the same reference numerals, and they are not described again.

As can be seen in FIG. 12, recesses or milled portions 751 are formed in the base 175 to receive the second radial arms 136, a line 145 for biasing the anode 125, and wires 313, 323, and 333 for powering the outer coils 131 and the first and second inner coils 133, 132 (FIGS. 7 and 12). A recess can also be formed in the base 175 to receive the pipe 126 for feeding ionizable gas and provided with an isolator 300 (shown for example in FIG. 4).

Advantageously, the outer coils 131 and the first and second inner coils 133 and 132 are made of shielded wire with mineral insulation. The wires of the various turns of the coils 131, 132, and 133 are secured by a brazing metal having high thermal conductivity.

The outer coils 131 and the first and second inner coils 133 and 132 are connected in series and are electrically connected to the cathode 140 and to a negative pole of the electrical power for anode-cathode discharge.

Figure 14:
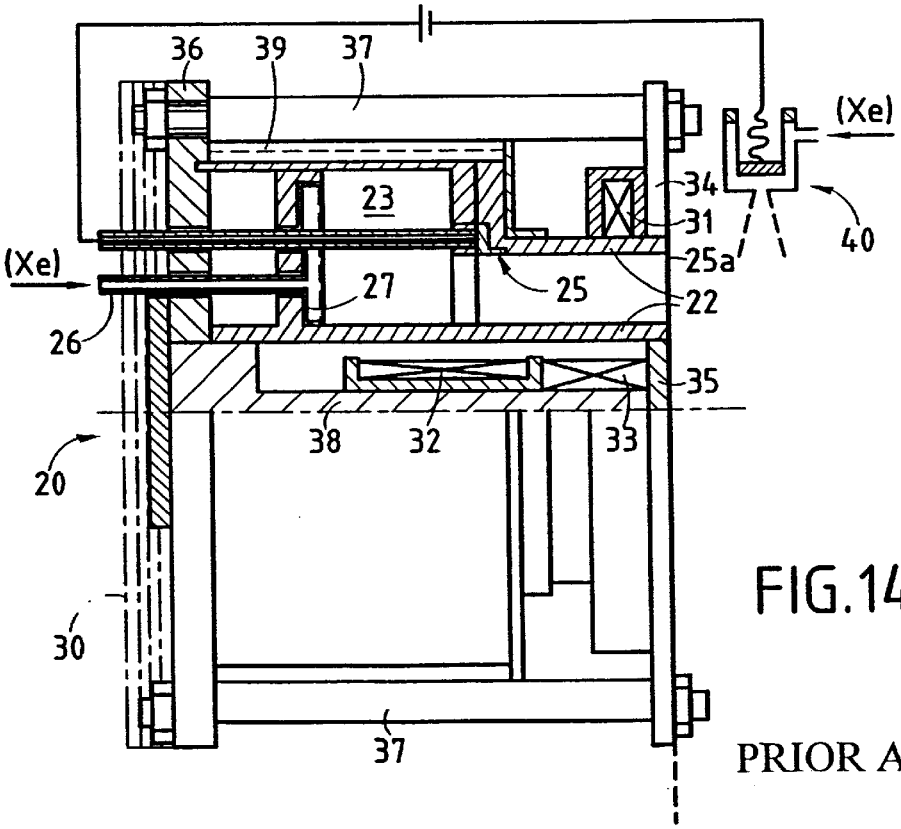
FIG.14 PRIOR ART
FIG. 14 is an elevation and axial half-section view of a second prior art closed electron drift plasma thruster.

In prior art embodiments, such as the embodiment shown in FIG. 14, an annular buffer chamber 23 is implemented of size in the radial direction that is not less than the size of the main annular channel 24 and that extends upstream therefrom beyond the zone in which the annular anode 25 is placed.

In an embodiment of the invention of the kind shown in FIG. 1, a more compact disposition is obtained by using a main annular channel 124 which is of a section in an axial plane that is frustoconical in shape in its upstream portion, and cylindrical in shape in its downstream portion. Under such circumstances, the annular anode 125 has, in an axial plane, a tapering section in the form of a truncated cone.

It has been observed that a calming chamber effect can be obtained in the main channel 124 by increasing gas density locally, i.e. by reducing the gas flow section in the upstream direction, instead of increasing it.

Figure 4:
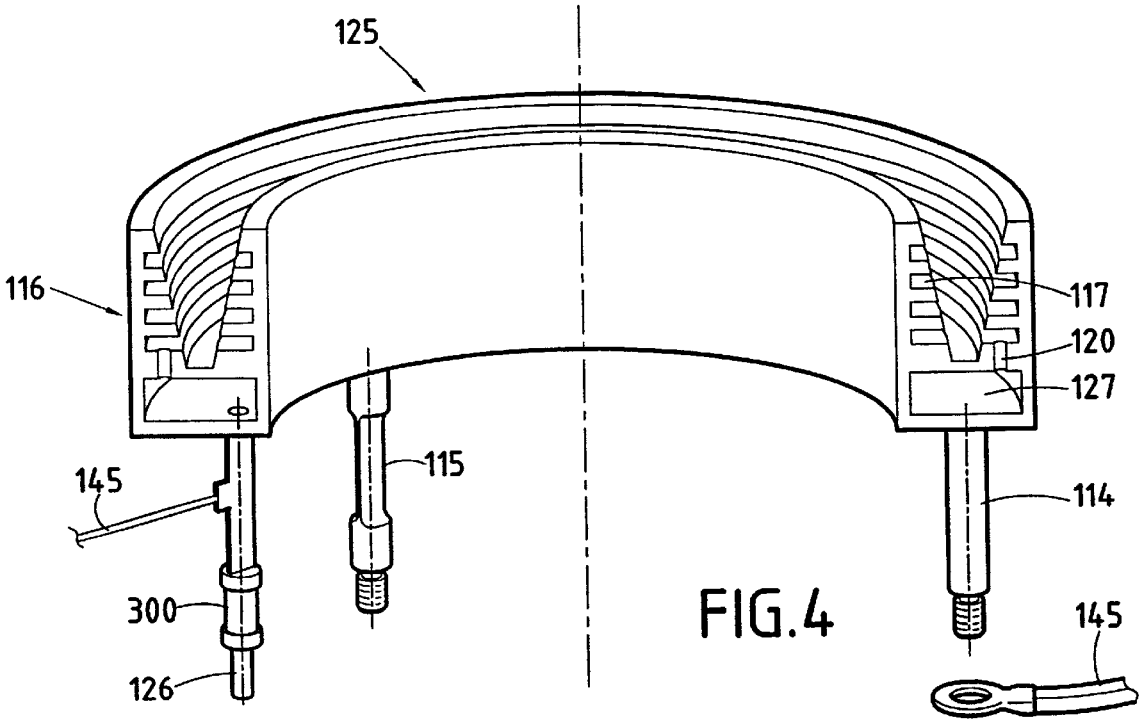
FIG. 4 is a perspective and axial section view of an anode suitable for incorporation in a plasma thruster of the invention.

FIG. 4 shows one possible embodiment of the annular anode 125. A series of circular slots 117 formed in the solid portion 116 of the anode 125 makes it possible to provide protection against contamination. The ionizable gas is introduced via a rigid pipe 126 into a distribution chamber 127 which communicates with the circular slots 117 via injection holes 120. An isolator 300 is interposed between the pipe 126 and the anode 125 which is connected by an electrical connection 145 to the positive pole of the electrical power supply for anode-cathode discharge.

It is also appropriate to be able to remedy problems of differential expansion between the anode 125 and the parts 122 that are made of ceramic material and that define the channel 124.

For a solid anode fixed on three circular columns, it is possible to find an acceptable compromise between a high natural frequency of vibration as is obtained with columns that are short and acceptable thermomechanical stresses which require columns that are long.

One possible solution is shown in FIG. 4. The anode 125 is supported both by a solid column 114 of circular section and by two columns 115 that have been thinned-down to form flexible blades, thereby achieving a compromise that is satisfactory from the point of view of differential thermal expansion.

Figure 5:
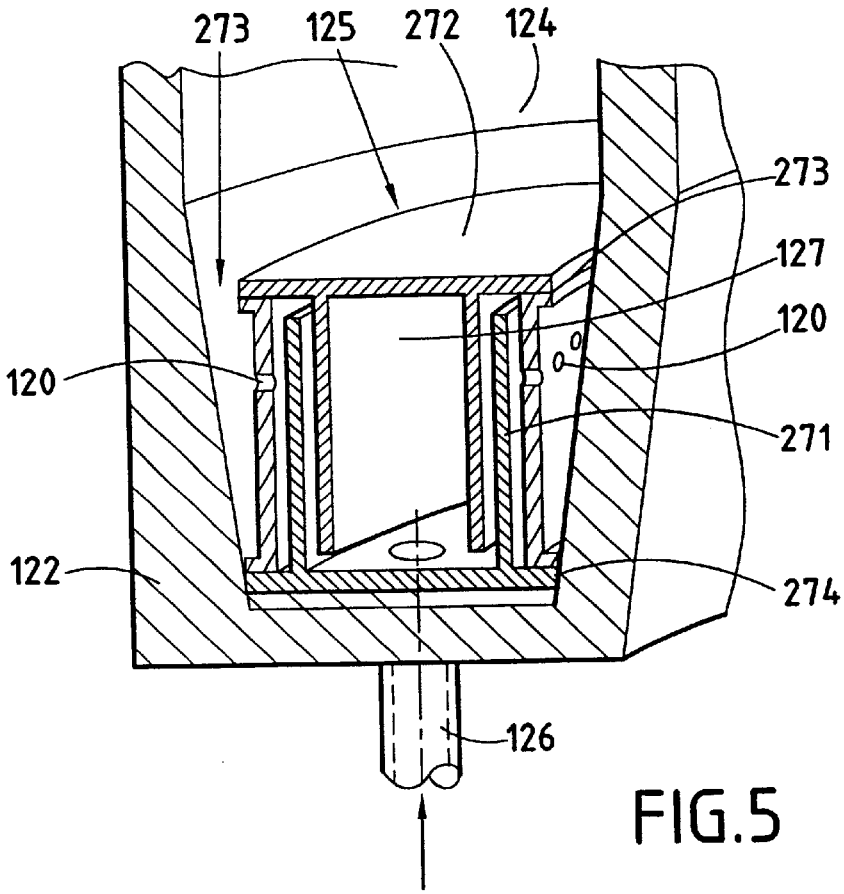
FIG. 5 is a fragmentary perspective and axial half-section view of another anode of simplified structure suitable for incorporation in a plasma thruster of the invention.

FIG. 5 shows another possible embodiment of an anode 125 placed in the frustoconical portion of an acceleration channel 124. In this case, the annular anode 125 has a manifold 127 fitted with internal baffles 271 and including a downstream plane plate 272 co-operating with the walls of the main channel 124 to define two annular diaphragms 273. A rear plate 274 is fitted on the walls 122 of the main channel 124 to limit gas leakage in an upstream direction. Cylindrical walls with holes 120 enable the ionizable gas to be injected into the main channel 124.

What is claimed is:

1. A closed electron drift plasma thruster adapted to high thermal loads, the thruster comprising a main annular channel for ionization and acceleration that is defined by parts made of insulating material and that is open at its downstream end, at least one hollow cathode disposed outside the main annular channel adjacent to the downstream portion thereof, an annular anode concentric with the main annular channel and disposed at a distance from the open downstream end, a pipe and a distribution manifold for feeding the annular anode with an ionizable gas, and a magnetic circuit for creating a magnetic field in the main annular channel, wherein the magnetic circuit comprises:

an essentially radial first outer pole piece;

a conical second outer pole piece;

an essentially radial first inner pole piece;

a conical second inner pole piece;

a plurality of outer magnetic cores surrounded by outer coils to interconnect the first and second outer pole pieces;

an axial magnetic core surrounded by a first inner coil and connected to the first inner pole piece; and a second inner coil placed upstream from the outer coils.

2. A plasma thruster according to claim 1, including a plurality of radial arms connecting the axial magnetic core to the upstream portion of the conical second inner pole piece, and a plurality of second radial arms extending the first radial arms and connected to said plurality of outer magnetic cores and to the upstream portion of the conical second outer pole piece.

3. A plasma thruster according to claim 2, wherein the number of first radial arms and the number of second radial arms is equal to the number of outer magnetic cores.

4. A plasma thruster according to claim 2, wherein a small gap is left between each first radial arm and the corresponding second radial arm.

5. A plasma thruster according to claim 1, wherein the main annular channel has a section in an axial plane that is frustoconical in shape in its upstream portion and cylindrical in shape in its downstream portion, and wherein the annular anode has a section in an axial plane that tapers in the form of a truncated cone.

6. A plasma thruster according to claim 1, including a structural base of a material that is a good conductor of heat which constitutes a mechanical support of the thruster, which is distinct from the axial magnetic core, from the first and second outer pole pieces, and from the first and second inner pole pieces, and which serves to cool the first inner coil, the second inner coil, and the outer coils by conduction.

7. A plasma thruster according to claim 6, wherein the structural base is covered on its lateral faces in an emissive coating.

8. A plasma thruster according to claim 6, wherein the parts defining the main annular channel define an annular channel in the form of a single block, are connected to the base by a single support provided with expansion slots, and are secured to the single support by screw engagement.

9. A plasma thruster according to claim 6, wherein the annular main channel has a downstream end defined by two ring-shaped parts made of an insulating ceramic and each connected to the base via an individual support, and wherein the upstream portion of the annular main channel is embodied by the walls of the anode which is electrically isolated from the supports by vacuum.

10. A plasma thruster according to claim 9, wherein the ratio between the axial length of the parts made of insulating ceramic and the width of the channel lies in the range 0.25 to 0.5, and wherein the distance between the walls of the anode and the support of the parts made of insulating ceramic lies in the range 0.8 mm to 5 mm.

11. A plasma thruster according to claim 9, wherein the anode is fixed relative to the base by means of a solid column and by flexible blade.

12. A plasma thruster according to claim 2, including a structural base of a material that is a good conductor of heat which constitutes a mechanical support of the thruster, which is distinct from the axial magnetic core, from the first and second outer pole pieces, and from the first and second inner pole pieces, and which serves to cool the first inner coil, the second inner coil, and the outer coils by conduction, wherein recesses are milled in the base to receive the second radial arms, the ionizable gas feed pipe fitted with an isolator, a line for biasing the anode, and wires for powering the outer coils and the first and second inner coils.

13. A plasma thruster according to claim 1, including sheets of super-insulation material disposed upstream of the main annular channel, and sheets of super-insulation material interposed between the main annular channel and he first inner coil.

14. A plasma thruster according to claim 1, wherein the cone of the conical upstream second inner pole piece points downstream.

15. A plasma thruster according to claim 1, wherein the cone of the conical upstream second inner pole piece points upstream.

16. A plasma thruster according to claim 6, including a common support for supporting the first inner coil, the conical second inner pole piece, and the second inner coil which are fixed to said common support by brazing or by diffusion welding, and wherein said common support is assembled on the base by screw means with a thermally conductive sheet being interposed therebetween.

17. A plasma thruster according to claim 16, wherein the first inner coil is cooled by a heat pipe connected to the inner portion of the common support and situated in a recess of the magnetic core.

18. A plasma thruster according to claim 16, wherein the first inner coil is cooled by a plurality of heat pipes connected to the upstream portion of the common support and passing through orifices formed in the second inner pole piece.

19. A plasma thruster according to claim 1, wherein the conical second outer pole piece has openings therein.

20. A plasma thruster according to claim 19, wherein the first and second outer pole pieces are mechanically connected together by a non-magnetic structural link piece that has openings.

21. A plasma thruster according to claim 1, wherein the outer magnetic cores of the outer coils are inclined at an angle $\beta$ relative to the axis of the thruster in such a manner that the axes of the outer magnetic cores are substantially perpendicular to the bisector of the angle formed by the generator lines of the cones of the first and second outer pole pieces.

22. A plasma thruster according to claim 1, wherein the annular anode includes a manifold provided with internal baffles and having a plane downstream plate co-operating with the walls of the main channel to define two annular diaphragms, a rear plate fitted to the walls of the main channel to limit gas leakage in the upstream direction, and cylindrical walls provided with holes for injecting ionizable gas into the main channel.

23. A plasma thruster according to claim 6, wherein the base is made of light alloy that is anodized on its lateral face.

24. A plasma thruster according to claim 6, wherein the base is made of carbon-carbon composite material coated on its downstream face with a deposit of copper.

25. A plasma thruster according to claim 1, wherein the outer coils and the first and second inner coils are made of shielded mineral-insulated wire and wherein the wires of the various turns of the coils are held together by a brazing metal having high thermal conductivity.

26. A plasma thruster according to claim 1, wherein the outer coils and the first and second inner coils are connected in series and are electrically connected to the cathode and to a negative pole of the electrical power supply for anode-cathode discharge.

27. A plasma thruster according to claim 1, wherein the conical second outer pole piece has a cone half-angle lying in the range 25° to 60°.

28. A plasma thruster according to claim 1, wherein the conical second inner pole piece has a half-angle relative to the axis of the thruster lying in the range 15° to 45°.

* * * * *

UNITED STATES PATENT AND TRADEMARK OFFICE

CERTIFICATE OF CORRECTION

PATENT NO. : 6,281,622 B1
DATED : August 28, 2001
INVENTOR(S) : Dominique Valentian et al.

It is certified that error appears in the above-identified patent and that said Letters Patent is hereby corrected as shown below:

Column 11,
Line 65, "he first" should read -- the first --.

Signed and Sealed this

Eleventh Day of June, 2002

*Attest:*

*Attesting Officer*

JAMES E. ROGAN
*Director of the United States Patent and Trademark Office*